US008579402B2

(12) United States Patent
Uptergrove

(10) Patent No.: US 8,579,402 B2
(45) Date of Patent: Nov. 12, 2013

(54) DIGITAL PRINTING PLASTIC CONTAINERS

(75) Inventor: Ronald L. Uptergrove, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 31 days.

(21) Appl. No.: 12/604,557

(22) Filed: Oct. 23, 2009

(65) Prior Publication Data

US 2010/0038339 A1 Feb. 18, 2010

Related U.S. Application Data

(62) Division of application No. 11/562,655, filed on Nov. 22, 2006, now Pat. No. 7,625,059.

(51) Int. Cl.
*B41J 29/38* (2006.01)

(52) U.S. Cl.
USPC ..... 347/16; 347/105

(58) Field of Classification Search
USPC ..... 347/16, 95–101, 104–105
See application file for complete search history.

(56) References Cited

U.S. PATENT DOCUMENTS

| | | | | |
|---|---|---|---|---|
| 3,417,175 | A | 12/1968 | Brown et al. | |
| 3,490,363 | A | 1/1970 | Derrickson | |
| 3,999,190 | A | 12/1976 | Brown et al. | |
| 4,519,310 | A | 5/1985 | Shimizu et al. | |
| 5,011,862 | A | 4/1991 | Melber et al. | |
| 5,182,571 | A * | 1/1993 | Creagh et al. | 347/105 |
| 5,753,325 | A | 5/1998 | McDaniel | |
| 5,858,514 | A * | 1/1999 | Bowers | 428/32.24 |
| 5,984,456 | A * | 11/1999 | Bern | 347/55 |
| 6,002,844 | A | 12/1999 | Kishida et al. | |
| 6,082,563 | A | 7/2000 | Kohn et al. | |
| 6,135,654 | A * | 10/2000 | Jennel | 400/61 |
| 6,406,115 | B2 * | 6/2002 | Mantell et al. | 347/15 |
| 6,409,294 | B1 | 6/2002 | Zimmermann et al. | |
| 6,460,991 | B1 | 10/2002 | Temple et al. | |
| 6,513,435 | B2 | 2/2003 | Detzner | |
| 6,682,191 | B2 | 1/2004 | Temple et al. | |
| 6,706,342 | B2 | 3/2004 | Kong et al. | |
| 6,769,357 | B1 | 8/2004 | Finan | |
| 7,128,406 | B2 | 10/2006 | Dixon et al. | |
| 7,182,418 | B2 | 2/2007 | Harvey et al. | |
| 7,579,388 | B2 | 8/2009 | Kiefer | |
| 2002/0097280 | A1 | 7/2002 | Loper et al. | |
| 2005/0211371 | A1 | 9/2005 | Hirst et al. | |
| 2006/0115639 | A1 * | 6/2006 | de Vries et al. | 428/212 |
| 2006/0250464 | A1 | 11/2006 | Sheinman | |

FOREIGN PATENT DOCUMENTS

| | | | |
|---|---|---|---|
| WO | WO 03/002349 | A2 | 1/2003 |
| WO | 2004/043702 | A1 | 5/2004 |

* cited by examiner

*Primary Examiner* — Thinh Nguyen
(74) *Attorney, Agent, or Firm* — Dykema Gossett PLLC

(57) ABSTRACT

A hollow plastic container having a curved external surface and a digital image printed thereon by ink droplets is provided. The ink droplets may vary in diameter from about 10 to about 200 microns and the droplets may range from about 200 to about 1200 drops per inch. Methods for digital printing plastic containers are also disclosed.

22 Claims, 6 Drawing Sheets

DIGITAL PRINTING PLASTIC CONTAINERS

CROSS-REFERENCE TO RELATED APPLICATIONS

This application is a divisional of application Ser. No. 11/562,655, filed Nov. 22, 2006, the entire contents of which are herein incorporated by reference.

TECHNICAL FIELD

The present invention relates generally to plastic containers having digital images printed thereon, particularly containers with curved surfaces, and methods for printing images on plastic containers.

BACKGROUND

Conventional techniques for printing onto curved surface plastic containers are subject to certain limitations and drawbacks. Such techniques make it difficult to provide a container, particularly a container having a non-planar surface, with an image that is commercially acceptable. A further challenge, is to efficiently provide a container with a multicolor digital image printed at acceptable speeds and at a reasonable cost.

SUMMARY

The present invention provides for the printing of one or more digital images on a hollow plastic container having a non-planar external surface. The digital image is printed on the container by application of ink droplets. The ink droplets may vary in diameter from about 10 to about 200 microns and the droplets may range from about 200 to about 1200 drops per inch. Methods for digital printing plastic containers are also disclosed.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
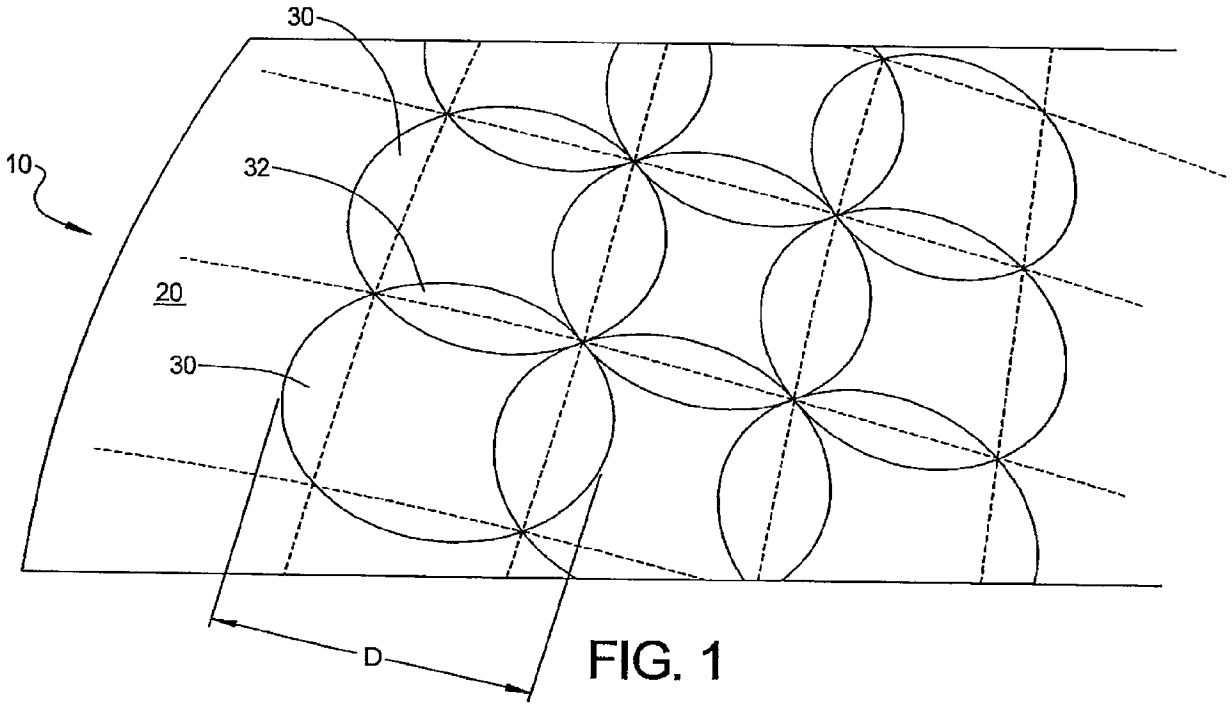
FIG. 1 is a top perspective view illustrating a pattern of ink droplets applied to a non-planar surface of a container according to an embodiment of the invention.

A portion of a container 10 having a non-planar surface 20 is generally illustrated in FIG. 1. A plurality of droplets of ink (or ink droplets) 30, are shown disbursed upon the surface 20 of the container. The droplets of ink 30 collectively may form part of an application pattern which, in turn, may form all or a portion of a predefined digital image. The application pattern may comprise a grid-type pattern, such as the grid pattern shown or, alternatively, may take on other forms of controlled or defined application patterns. Further, as generally illustrated, portions of one or more adjacent ink droplets 30 may overlap or intermix with each another, forming overlapped portions 32.

Figure 2A:
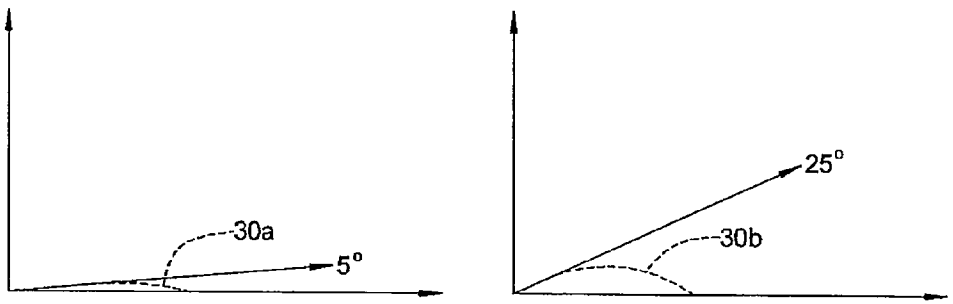
FIG. 2A is a side view of an ink droplet illustrating associated angular measurements.
Figure 2:
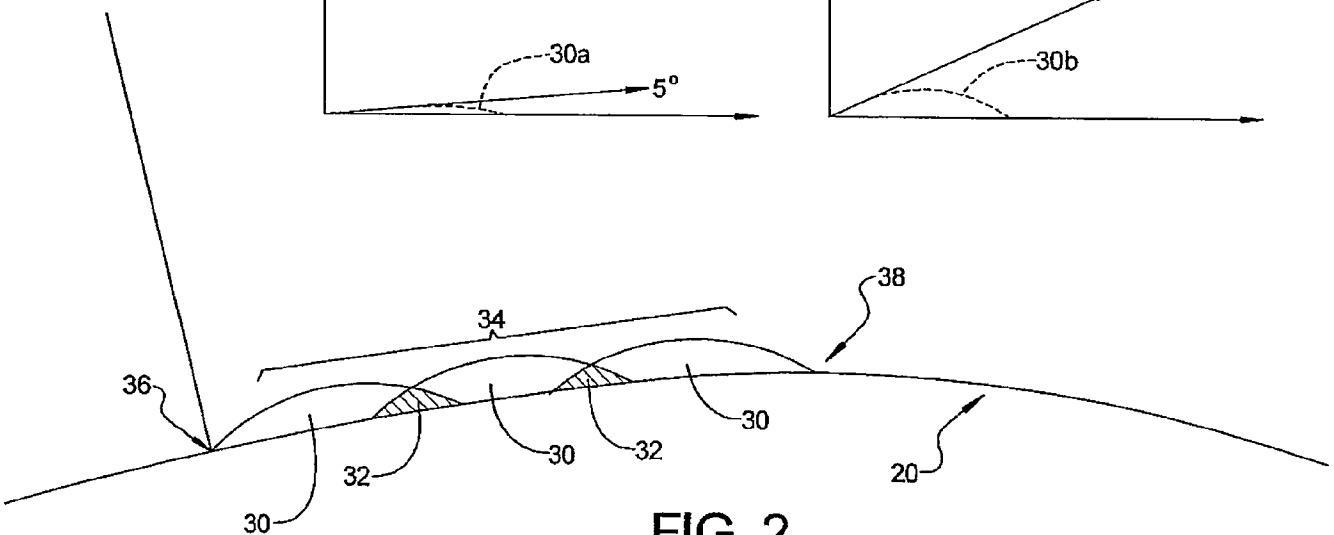
FIG. 2 is a side view of a series of ink droplets with overlapping portions.

FIG. 2 a side view of a series of ink droplets 30 with overlapping portions 32 that exhibit a contiguous area of ink 34. Viewed in cross section, the contiguous area of ink extends from a first drop edge 36 to a second drop edge 38. As perhaps better illustrated in FIG. 2A, in an embodiment, the contact angles (or angles of the edges) for the droplets of ink, which are represented by ink droplets 30*a* and 30*b* in the figure, range from about 5 degrees to about 25 degrees. Moreover, in a particular embodiment, the contact angles may range between about 12 to about 15 degrees.

Depending upon the desired digital image or images, the individual ink drops can comprise various known colors, including for instance, primary printing colors such as cyan, magenta, and yellow. Moreover, controlling the overlapping or combinations of certain colors in overlapping areas, such as overlapped portions 32 can provide additional "process" colors. Additionally, the ink droplets may be curable. For example, UV curable ink droplets may comprise all or a portion of the digital image.

Individual ink droplets 30, including those associated with a single digital image, can vary in diameter D from about 10 microns to about 200 microns. In a particular embodiment, the diameter D of the droplets can range from about 30 microns to about 90 microns. Additionally, the application of ink drops provided on the surface of the container to form the digital images ranges from about 200 to about 1200 drops per inch (DPI) and, in an embodiment, may range from 300 to 1200 DPI. The resulting digital image formed on a container surface may, for example and without limitation, take the form of a label and may include various text and/or graphics, including color text and graphics.

Figure 3:
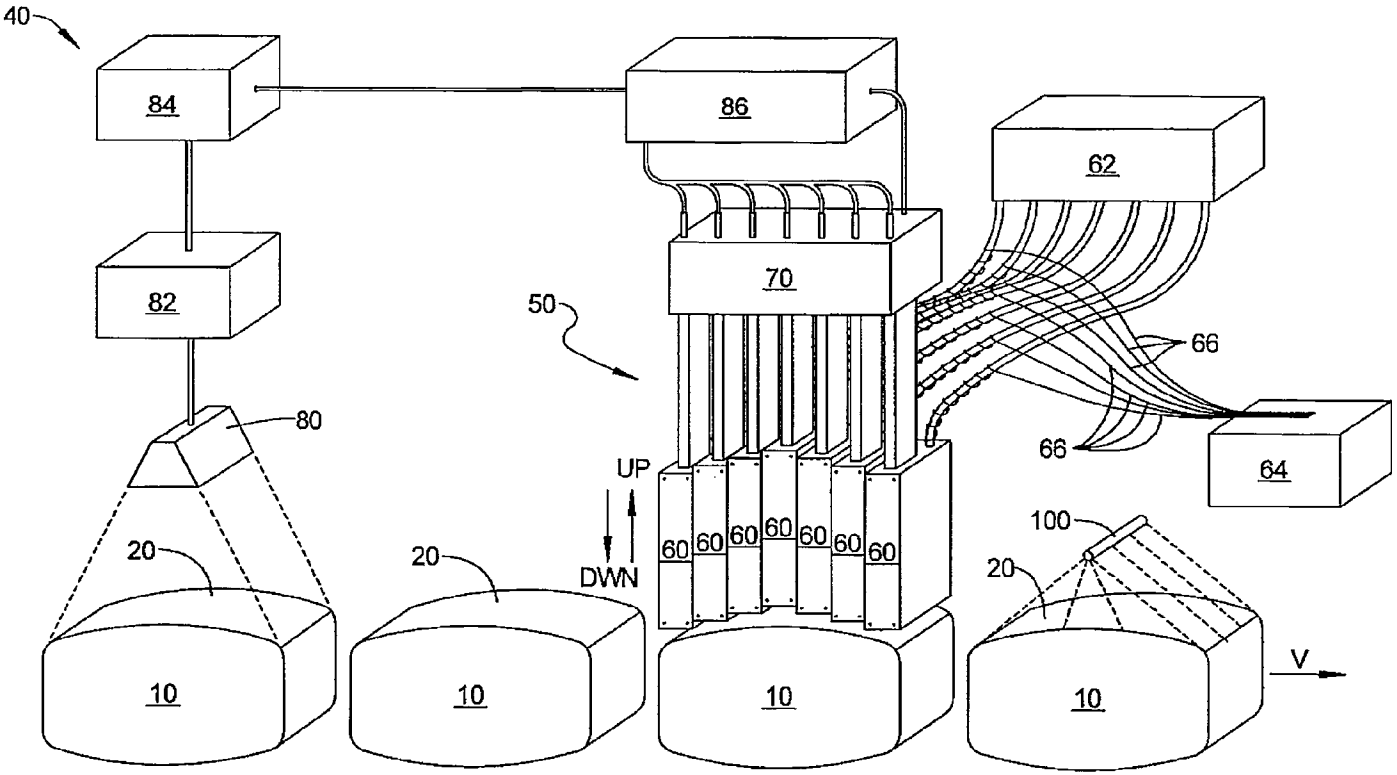
FIG. 3 is a graphical representation of an ink droplet application system according to an embodiment of the invention.

An ink droplet application system 40 according to an embodiment of the invention is shown in FIG. 3. As generally illustrated, a plurality of containers 10, which may include a non-planar (e.g., oval, round, or simply generally curved) surface 20, may be transported or conveyed past a printing subsystem 50. The printing subsystem may comprise one or more print heads 60; at least one actuator 70 for controlling the up-down position of the print head or heads relative to the containers; an ink delivery device 62 for delivering one or more types or colors of ink to one or more print heads; and a temperature control device 64, which serves to at least in part regulate or control the temperature of the ink, and may include a plurality of fluid lines 66.

Figure 4:
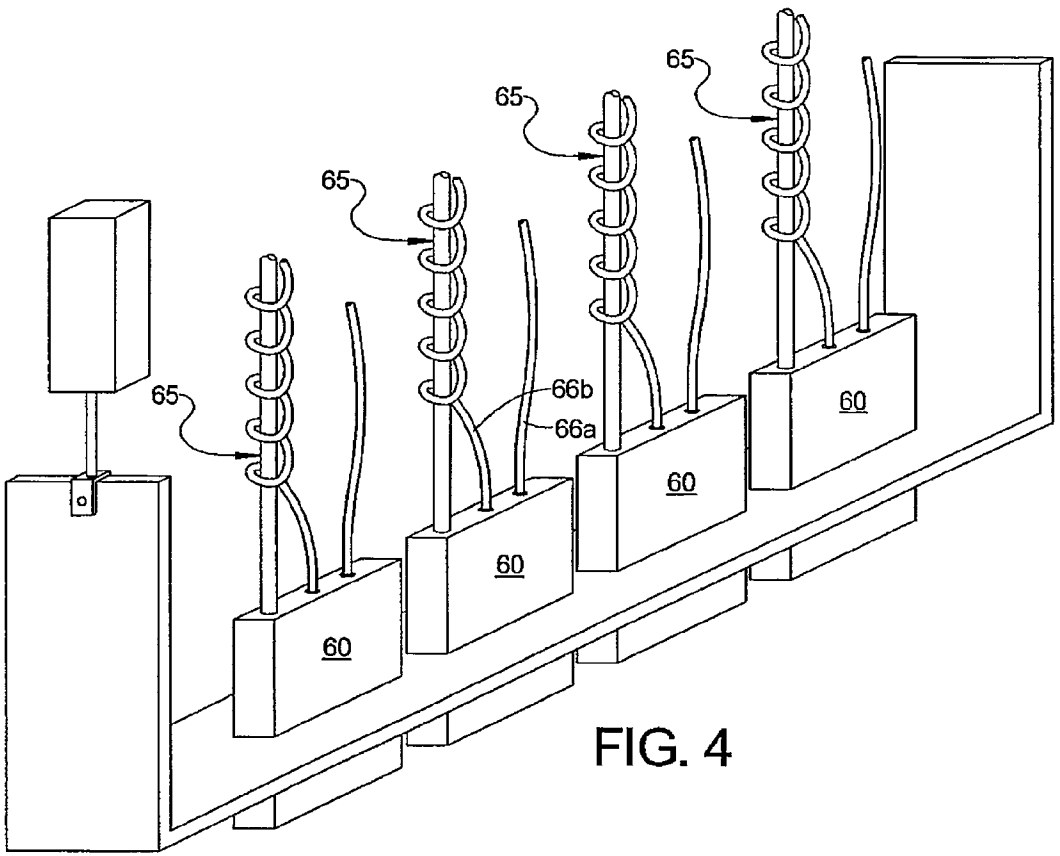
FIG. 4 is a graphical representation of a portion of a printing subsystem in accordance with an embodiment of the invention.

In an embodiment, the temperature control device may include fluid heating units and one or more pumps that circulate heated water or other fluid. If desired, the fluid may be circulated in a closed circuit. FIG. 4 illustrates an embodiment of the system 40 in which individual print heads 60 are supplied with ink through ink lines 65 and include, for instance, a plurality of water lines. The water lines may comprise a circuit and include input lines 66*a* and supply return lines 66*b*. In an embodiment, the water lines (e.g., return lines 66*b*) may be wrapped around ink lines 65. If desired, the fluid lines, such as the illustrated water lines 66*b*, may be wrapped around the ink lines 65 from the ink source to the print heads. Alternatively, the flow of fluid could be reversed, and the inlet fluid lines could be lines 66*b* and the output fluid lines could be 66*a*. In either case, such fluid lines help to maintain the ink at a desired temperature throughout the system while associated print heads move up and down.

The ink can be maintained at a temperature or a desired temperature range within the print heads for delivery of ink droplets to the surface of the container to be treated. In an embodiment of the invention, the ink is maintained at a temperature in the print heads (i.e., just prior to dispersion or application) from about 40° C. to about 50° C.

In FIG. 3, the containers 10 are generally shown being transported by a conveyor. However, it is important to note that the invention is not limited to such a means of conveyance. Rather, the containers may be transported past the printing subsystem 50 in other manners and using other container handling techniques provided the surface that is to be printed upon is not operatively obstructed from the print heads 60 and the position of the surface that is to be printed upon can be sufficiently established in space with respect to the printing subsystem so that the print heads can be positioned to maintain a controlled distance from the surface. For example, without limitation, the containers may be temporarily retained in a fixture or holder that moves past the print heads.

The application system 40 may additionally include a scanning device 80, such as a laser scanner. The scanning device 80 can be used to scan each container surface that is to be printed upon prior to moving the container through the printing subsystem 50. The scanning device 80 can capture surface profile data for the surface of the container to be printed, including, for example, surface variability and curvature data. In an embodiment, the scanned surface data is communicated to a signal conditioner 82, which may condition the data and communicate the data or conditioned data to a processor 84. The processor 84 processes the information and provides motion control signals to a motion controller 86, which in turn can provide control signals to the actuator 70 for positioning one or more print heads 60 at a given point in time (relative to and coordinated with the surface of the container being moved).

It is important to note that the system 40 is not limited to one having a separate and distinct scanning device, signal conditioner, processor, motion controller, and/or actuator. Rather, such components may be provided in various combinations or have their functions combined in various operative combinations without departing from the scope of the present invention. For example, in a simplified embodiment, the scanning device may develop container surface data, communicate the data, whether directly or indirectly, to the print heads (or the actuator or controller controlling the position of the print heads), and the distance between the print heads and the container surface to be printed can be controlled while the container moves past the print heads.

Figure 5:
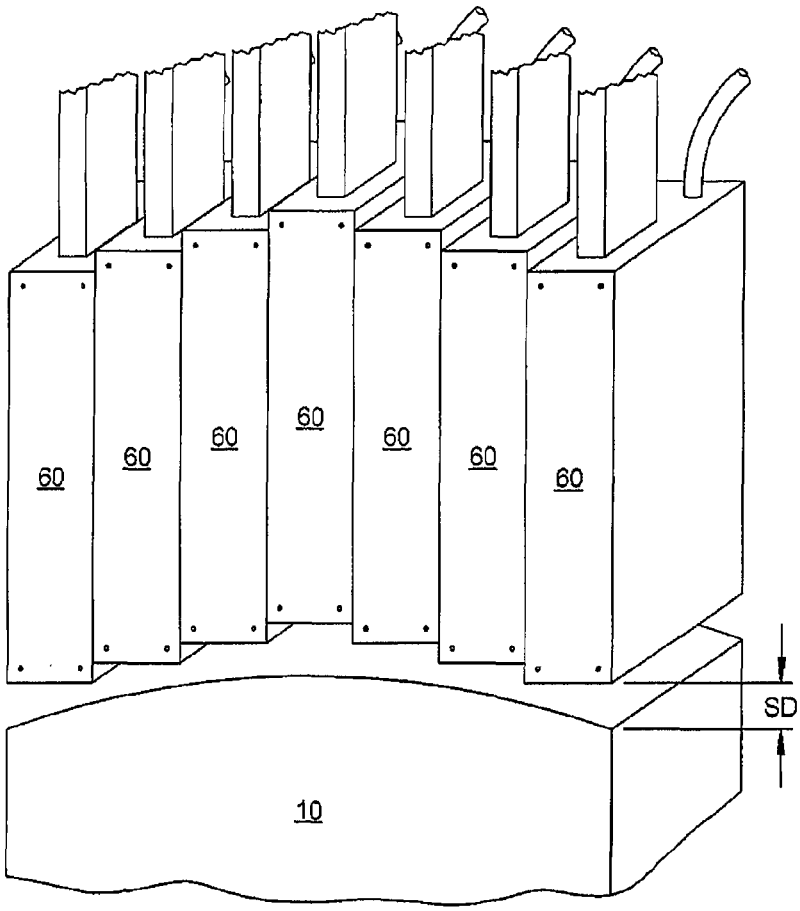
FIG. 5 is a graphical representation of a printing subsystem according to an embodiment of the invention.

The printing subsystem controls the position of the print heads 60 and, for a non-planar surface, can effectively maintain a defined or controlled offset with respect to the surface of the container. For example, as generally illustrated in the embodiment of the system shown in FIG. 5, the system 40 can be configured to maintain a 1 mm±0.3 mm standoff distance SD between the portion of the print head dispensing ink and the surface of the container that receives the droplets of ink. It is worthwhile to note that, for embodiments of the invention, the standoff distance SD may be said to particularly pertain to the distance between the portion of the print head 60 that provides the ink (at the time the ink is applied) and the surface of the container that receives the ink droplets. That is, portions of a print head 60 that do not coincide to the portions of the print head that apply the ink may encroach the space associated with the standoff distance SD, provided, however, that such encroachment should not create a physical interference between a print head and a container.

With further reference to FIG. 3, in an embodiment of the system 40, the containers are moved at a constant or substantially constant velocity past the print heads. However, embodiments of the system can include sensors that determine, monitor, and/or control the speed of movement (i.e., the velocity V) of the containers at one or more stages in the system. The system 40 can, for example, provide such information to a processor or controller, and coordinate the movement of the print heads to adjust for the constant or non-constant movement of the containers past the print heads. Moreover, one or more feedback control systems can be incorporated into the system to serve such a control function and coordinate the position and movement of the print heads relative to a container that is moving past the print head.

For some applications, the containers may be pre-treated prior to entering the printing subsystem 50 or passing a print head. Pre-treatment can be used, for instance, to increase the surface temperature of a container to provide improved bonding with the droplets of ink. Some known pre-treating techniques include, without limitation, flame, corona, and plasma treatment. However, the invention is not limited to those pre-treatment options.

Figure 6:
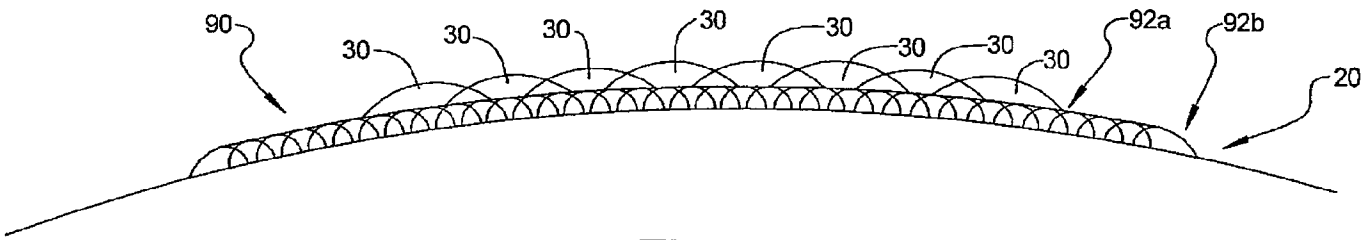
FIG. 6 is a side view of droplets of ink applied to a base coat.

Additionally, the system 40 may provide for the application of a base coat to a portion of the surface of a container prior to printing a digital image. For example, FIG. 6 generally shows a side view of droplet of ink 30 applied to a base coat 90. In the figure, the contact angle (or angle of the edge) for the droplets is generally identified by arrow 92*a*; the contact angle for the base coat is shown generally identified by arrow 92*b*. In an embodiment, the contact angles associated with the droplets of ink and/or the base coat may be between about 5 degrees to about 25 degrees and, for some applications, one or both may be between about 12 and about 15 degrees. The base coat may be comprised of material that serves to improve the application of ink droplets and/or provides a visual characteristic. If desired, all or a portion of the base coat may be digitally printed on at least a portion of a surface of the container. In an embodiment of the invention, one or more digital images are printed entirely on a base coat. Further, for some applications, a portion of the base coat and/or a portion of the surface of the container may form a portion of the digital image. For example, if a portion of the intended digital image includes a color that sufficiently matches that of the surface of the container, or a base coat (if applicable), the printing subsystem can be programmed to controllably avoid dispersion of droplets of ink over such portions.

Referring again to FIG. 3, the system 40 may further include a means for curing droplets of ink associated with the digital image. For example, if UV curable inks are applied, the means for curing may include one or more UV lamps 100. Moreover, the digital images printed on the surface of the container may be prescribed to be cured within a defined period. For example, in an embodiment, the digital images are cured between 0.5 seconds and 5 seconds after the ink droplets contact the container surface.

The application system 40 may also include a post-printing scanner (not shown) that scans the final digital image. The system can then evaluate the post-printing data to assess whether or not the image printed on a given container meets a prescribed or established criteria, which may generally correlate to the quality of the image. If the image printed on the container does not meet the prescribed or established criteria, a communication may be initiated (such as an alarm or notification to an operator) and the container may be routed to an area for further assessment and disposal or rework.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A plastic container comprising: a hollow container having a curved external surface with a digital image printed thereon by digitally printed droplets of ink, wherein the ink droplets vary in diameter from 10 to 200 microns, the droplets of ink range from 200 to 1200 drops per inch, wherein the container includes a base coat comprised of droplets of ink that are directly printed on the curved external surface of the container, and wherein the digital image is printed as a discrete outer layer provided on at least a portion of the base coat.

2. A container according to claim 1, wherein the droplets of ink vary in diameter from 30 to 90 microns.

3. A container according to claim 1, wherein the droplets of ink range from 300 to 1200 drops per inch.

4. A container according to claim 1, wherein the droplets of ink are spread out on the container surface and portions of droplets overlap with adjoining droplets.

5. A container according to claim 1, wherein the droplets of ink are provided in a grid pattern.

6. A container according to claim 5, wherein the grid pattern is defined by a calculated or anticipated droplet disbursement.

7. A container according to claim 1, wherein the angle of the edges of the droplets of ink is from about 5 degrees to about 25 degrees.

8. A container according to claim 1, wherein the angle of the edges of the droplets of ink is from about 12 degrees to about 15 degrees.

9. A container according to claim 1, wherein the digital images have multiple colors.

10. A container according to claim 1, wherein portions of adjacent droplets of ink overlap to provide one or more process colors.

11. A container according to claim 1, wherein at least a portion of the droplets of ink are UV curable.

12. A container according to claim 1, wherein the droplets of ink define a pre-determined image on the container surface.

13. A container according to claim 1, wherein individual droplets of ink have varying diameters.

14. A container according to claim 1, wherein the base coat is separately cured prior to printing of the digital image.

15. A container according to claim 14, wherein the base coat is a digitally printed base coat.

16. A container according to claim 1, wherein the entire digital image is printed on the base coat.

17. A container according to claim 1, wherein a portion of the base coat forms a portion of the digital image.

18. A container according to claim 1, wherein a portion of the surface of the container provides a portion of the color forming part of the digital image.

19. A container according to claim 1, wherein the digital images are cured between 0.5 seconds and 5 seconds after the ink droplets contact the container surface.

20. A container according to claim 19, wherein the container is pre-treated by a flame, corona, or plasma treatment.

21. A container according to claim 1, wherein the container is pre-treated to raise the surface temperature of the container prior to bonding with the digitally printed droplets of ink.

22. A plastic container comprising: a hollow container having a curved external surface with a digital image comprised of multiple colors printed on a portion of the external surface by digitally printed droplets of ink, wherein the ink droplets vary in diameter from 10 to 200 microns, the droplets of ink range from 200 to 1200 drops per inch, the droplets of ink are spread out on the container surface and portions of droplets overlap with adjoining droplets, the angle of the edges of the droplets of ink is from about 5 degrees to about 25 degrees, wherein the container includes a base coat and wherein the digital image is printed at least on at least a portion of the base coat.

* * * * *